US005941450A

United States Patent [19]

De Safey

[11] Patent Number: 5,941,450

[45] Date of Patent: Aug. 24, 1999

[54] APPARATUS FOR CONNECTED FILE FOLDERS

[76] Inventor: Frank F. De Safey, 22240 Varian Way, Cupertino, Calif. 95014

[21] Appl. No.: 08/873,346

[22] Filed: Jun. 10, 1997

Related U.S. Application Data

[63] Continuation-in-part of application No. 08/503,703, Jul. 18, 1995, Pat. No. 5,692,673.

[51] Int. Cl.[6] ..... B65D 3/00

[52] U.S. Cl. ..... 229/67.2; 312/184

[58] Field of Search ..... 229/67.1, 67.2, 229/67.4, 69; 383/68, 69, 78, 93, 107, 33, 35; 312/184

[56] References Cited

U.S. PATENT DOCUMENTS

| | | | |
|---|---|---|---|
| 1,297,994 | 3/1919 | Boyer | 383/107 X |
| 2,319,316 | 5/1943 | Gerendas | 383/68 X |
| 2,563,226 | 8/1951 | Ellis | 312/184 X |
| 3,086,264 | 4/1963 | Tindall | 383/68 X |
| 3,141,221 | 7/1964 | Faulls, Jr. | 383/69 X |
| 3,298,374 | 1/1967 | Grundell | 312/184 X |
| 3,458,110 | 7/1969 | Goldman | 383/69 X |
| 3,722,786 | 3/1973 | Honn et al. | 383/78 X |
| 3,905,538 | 9/1975 | Ohlson | 229/67.1 |
| 4,031,646 | 6/1977 | de Nouel . | |
| 4,156,445 | 5/1979 | Kontinen | 383/68 |
| 4,294,028 | 10/1981 | Remond . | |
| 5,066,045 | 11/1991 | Hawes, Jr. et al. . | |

FOREIGN PATENT DOCUMENTS

| | | | |
|---|---|---|---|
| 204591 | 5/1966 | Sweden | 383/78 |
| 508740 | 7/1939 | United Kingdom . | |
| 526470 | 9/1940 | United Kingdom . | |

*Primary Examiner*—Jes F. Pascua

*Attorney, Agent, or Firm*—Thomas Schneck; George B.F. Yee

[57] ABSTRACT

A coupling member is disclosed for connecting together adjacent hanging file folders. An elongate member includes a slot is formed along the full length thereof and positioned to receive the upper edges of the leaves of two adjacent folders. In a preferred embodiment, the slot is defined by two spaced-apart surfaces which extend into the interior region of the elongate member. The interior region may be solid or may be partially or fully hollow. The elongate member has any one of a number of cross-sectional profiles, including semi-circular, rectilinear, triangular and concave shaped profiles. In another embodiment of the present invention, the coupling member includes two slots each for receiving one of two adjacent folders.

12 Claims, 4 Drawing Sheets

APPARATUS FOR CONNECTED FILE FOLDERS

CROSS REFERENCE TO RELATED APPLICATION

This is a continuation-in-part of application Ser. No. 08/503,703, filed Jul. 18, 1995 now U.S. Pat. No. 5,692,673.

TECHNICAL FIELD

The present invention relates generally to file folders and more specifically to an apparatus for connecting together hanging file folders.

BACKGROUND OF THE INVENTION

File folders are one of the most readily recognized articles in an office setting. They are the means by which the numerous documents and other paperwork of a business are organized and maintained. Improvements in the construction and design of file folders have, over the years, increased their reliability and their utility. For example, the hanging folder described in U.S. Pat. No. 5,066,045 to Hawes, Jr. et al. discloses a hanging folder having reinforced strips along its top and bottom edges for protection against wear to the folder.

File folders typically are placed together in a file drawer so that each file is positioned adjacent to the next file. Because of such an arrangement, it occasionally occurs that a document which is intended to be inserted in a particular file inadvertently falls between the intended file and an adjacent file. Such misfiled papers may become lost or are not discovered until after a time-consuming search has been conducted.

A solution to this problem is described in U.S. Pat. No. 4,031,646 to deNouël, which discloses a suspensible file folder capable of connecting to an adjacent folder. A permanent magnet is affixed to one of the folder's two suspension hooks, and is exposed toward the outside of the folder. A ferromagnetic material is positioned on the other suspension hook and exposed in the opposite direction. In this manner, adjacent folders are coupled together by the magnetic attraction between the magnet of one folder and the ferromagnetic material of the adjacent folder. The coupling eliminates the space between folders and therefore the likelihood of misplacing a document. However, the parts used and the necessary manufacturing steps contribute significantly to the cost of the folders, and the additional components significantly increase the weight of folders so equipped.

Another interconnection mechanism is described in U.S. Pat. No. 4,294,028 to Reymond. The mechanism is a plate which is fixed to the surface of one folder and includes a pincer that is molded unitarily with the plate. The pincer engages with a corresponding male member attached to an adjacent folder, and thus effectuates a coupling between the two folders. See generally FIGS. 3–6. Reymond teaches that such components may be molded from a synthetic resin material. The Reymond coupling mechanism increases the cost of manufacture due to the complexity of the molded plate and the corresponding engagement member located on the adjacent folder.

In addition to misfilings between adjacent folders, it is further noted that current labeling schemes can be ineffective because the labels are usually of insufficient size to accommodate a fully descriptive title for the folder. A solution is offered in a product known as MAGNIFILES, marketed by ABBOT Office Systems. The product provides a folder having a coupling mechanism for coupling adjacent files, and further includes an enlarged area for labeling. The MAGNIFILES mechanism, however, is integrally formed with file folders that are specifically designed and manufactured to work with the mechanism. The folders have hanging members which have a thick design. This allows the MAGNIFILES mechanism to clamp onto an adjacent folder.

A shortcoming common to the above-described devices is the necessity for specially designed matching components. The prior art devices therefore are not capable of being used with file folders already in use in today's office environments.

What is needed is a file folder capable of being coupled to another folder, that is simpler to manufacture than the coupling mechanisms of the prior art and yet offers the desirous feature of preventing misfiled documents by eliminating the gap between adjacent folders. There is further need for a coupling member that can be used with existing non-connecting hanging file folders, such as the Pendaflex® brand hanging folders. It is also desirous to provide labeling of folders that is more effective than is presently available.

SUMMARY OF THE INVENTION

The present invention is directed to a detachable interlocking member for coupling together adjacent hanging-type folders, composed of an elongate member having a single slotted opening formed along the entire length thereof. The slot is positioned so as to receive the upper leaf portions of two adjacent folders, and is dimensioned so that flexure of the slot results upon insertion of the leaves. The elongate member is resilient so that a restoring force provides a friction gripping action upon the inserted leaves, thus maintaining a secure attachment.

An upper portion of the elongate member is disposed both opposite the slotted opening and along the entire length of the slotted opening. This upper portion serves to completely occlude or hide the gap that forms between adjacent folders thus preventing misfiling of papers.

The detachable interlocking member has a semi-circular cross section so as to provide a curved surface for mounting file identification labels. Other profile contours are possible; for example, a planar surface can be provided for mounting labels instead of a curved surface.

In a preferred embodiment, the slot formed along the detachable elongate member includes two spaced-apart surfaces which extend into the interior of the elongate member. In this way, the inserted leaf portions engage the slot with significant frictional force, thus providing a reliable coupling of the adjacent folders, while at the same time allowing for de-coupling of adjacent folders if so desired without damaging the folders.

In another embodiment, the detachable elongate member includes a dual-slotted configuration, each slot receiving the upper leaf portion of one of two adjacent hanging-type folders.

The coupling member of the present invention greatly enhances pre-existing hanging type folders such as Pendaflex® brand hanging folders, by allowing such folders to be coupled together thus obviating the purchase of specially designed folders having a built-in coupling capability. This reduces the cost of upgrading an existing filing system while at the same time increasing its utility. Also, since the coupling members are easily de-coupled, the filing system can be easily reconfigured as needed.

The various embodiments of the present invention are more fully described with reference to the included drawings and to the following discussion of the best mode contemplated for practicing the invention. In the drawings, similar elements of the invention are referenced by the same reference numerals.

BEST MODE OF CARRYING OUT THE INVENTION

Figure 1:
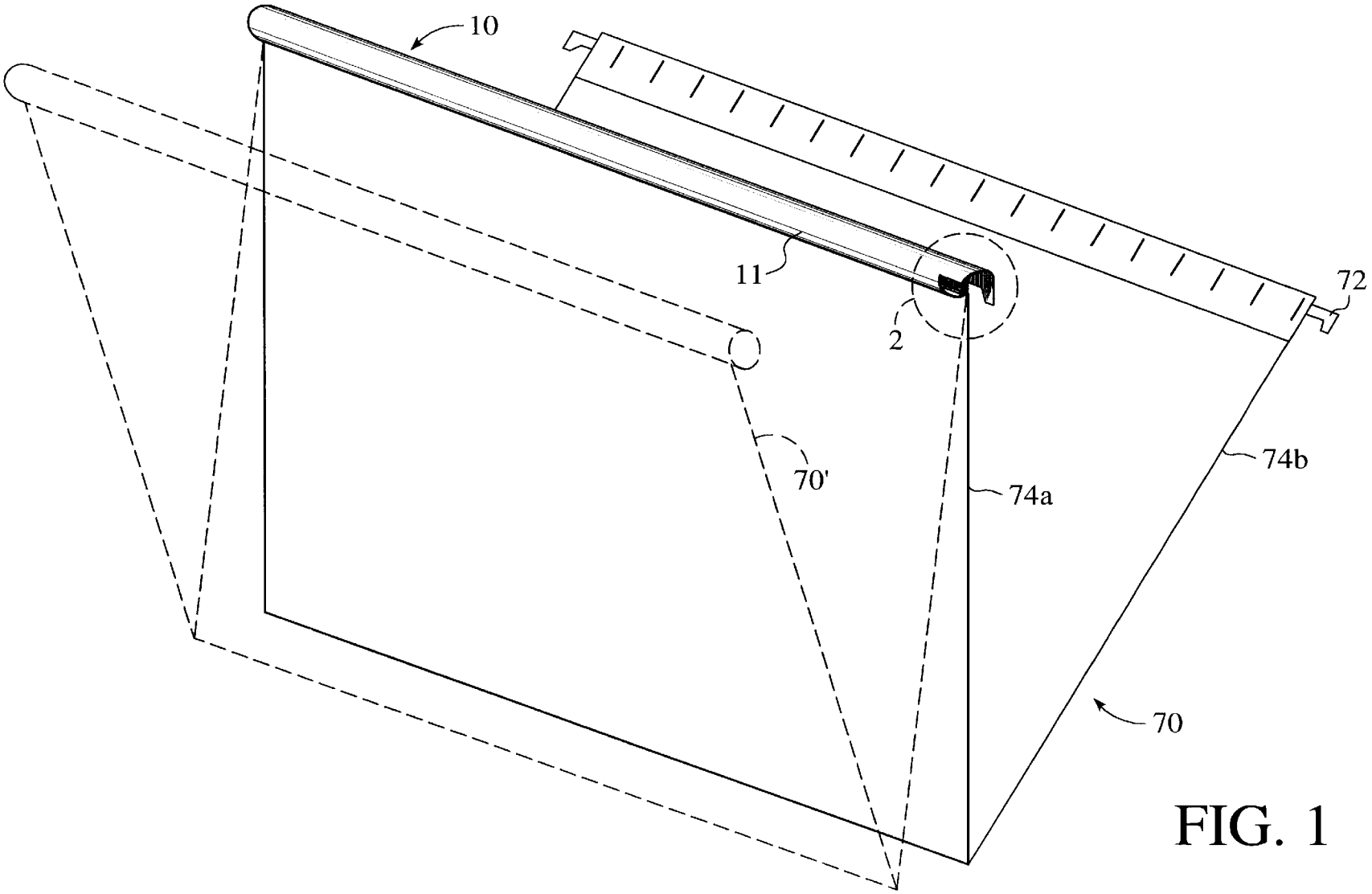
FIG. 1 shows a preferred embodiment of the coupling member used with a hanging file folder in accordance with the present invention.

FIG. 1 shows a folder interlocking (or coupling) member 10 in accordance with the present invention, attached to one flap 74A of a hanging file folder 70. The elongate body 11 of the coupling member 10 generally spans the width of the folder 70. File folders typically are produced in standard widths to accommodate documents such as letter size (11 inch) and legal size (14 inch) paper. It should be apparent, however, that the elongate body 11 can be easily manufactured to fit any of the standard sized folders, and more generally can be manufactured to fit folders having non-standard arbitrary widths. FIG. 1 further shows an adjacent folder 70', shown in phantom, coupled to the first folder 70 by the coupling member 10.

Figure 2:
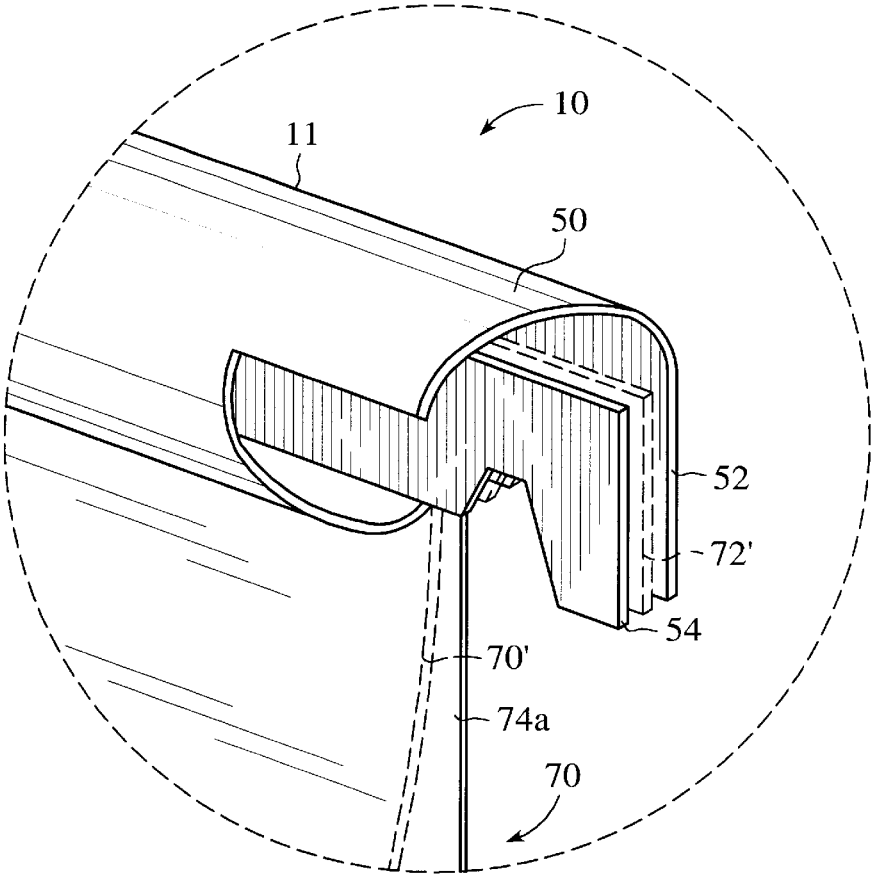
FIG. 2 is an enlargement of FIG. 1, illustrating the attachment of the coupling member to the file folder.

FIG. 2 is an enlargement of the circled region in FIG. 1. FIG. 2 shows in greater detail the positioning of the coupling member 10 with respect to the first folder 70 and the adjacent folder 70', as contemplated in the present invention. The extended portion 50 at each end of the elongate body 11 extends over the tangs or hooks 72' of the adjacent folder 70' to achieve a more visually pleasing effect. The additional structures shown in FIG. 2 will now be explained with further reference to FIG. 3.

Figure 3:
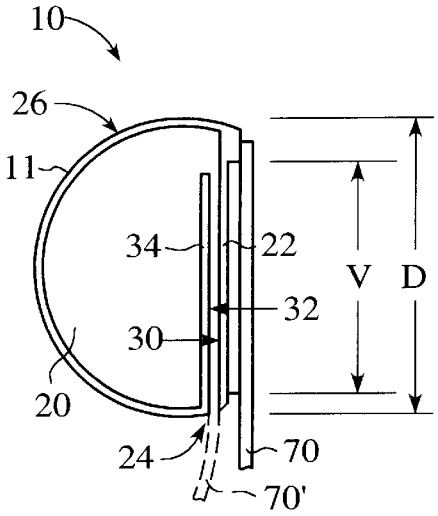
FIG. 3 is a cross-sectional view of the preferred embodiment of the coupling member of the present invention.

Turning to FIG. 3, additional detail is provided in a cross-sectional view of the elongate body 11. In the preferred embodiment, the elongate body is a hollow member having a hollow interior 20. The cross-sectional profile of the elongate body has a semi-circular shape 26. A flat portion 22 of the semi-circle is positioned proximal to an exterior surface of the folder 70. Returning to FIG. 3, the semi-circular profile 26 has a typical outside diameter measurement D on the order of one-half of one inch. The vertical measurement V of the flat portion 22 is roughly one-quarter of one inch. An adhesive strip 40 disposed along the flat portion 22 provides attachment of the coupling member 10 to the folder 70 by being pressed against the surface of the folder. It is to be noted that the elongate body 11 need not be fully hollow as shown in FIG. 3, and may be composed of a solid member or be formed with an interior region having some internal structure.

FIGS. 2 and 3 illustrate that the slot 24 is further defined by two spaced apart parallel surfaces 30, 32. As can be seen in FIG. 3, the first surface 32 is formed by extending a portion 34 of the elongate body 11 into its interior 20. The opposite surface 30 is conveniently obtained as the interior surface of the flat portion 22. It is noted that, alternatively, the opposite surface 30 may be formed independently of the flat portion 22. That is, another portion (not shown) of the elongate body 11 may be extended into the interior 20 to define a surface opposite to the first surface 32, in much the same way that the first surface is formed.

The opposed surfaces 30, 32 are separated by a distance at most equal to the thickness of the lip of an adjacent folder 70', typically on the order of one sixteenth of an inch. When the lip is inserted into the slot 24, the action tends to widen the slot causing the surfaces to flex. This flexure results in a force which tends to return the surfaces to their original unflexed positions. The closing tendency, along with the contact surface area between the lip and the surfaces 30, 32, provide a very reliable friction fit of the adjacent folder. This arrangement allows for use with existing file folders since special coupling mechanisms or specially designed folders such as described in the prior art are not required.

As can be seen in each of FIGS. 1, 2 and 3, the elongate body 11 occludes the gap between the two adjacent folders 70, 70' that are connected together by the coupling member 10, thereby eliminating the possibility of inadvertently misfiling a document between the two folders. The slot 24 is preferably formed close to the flat portion 22 so that the spacing between folders is kept to a minimum. However, the slot may be spaced apart from the flat portion without affecting the utility of the coupling member 10.

Figure 4:
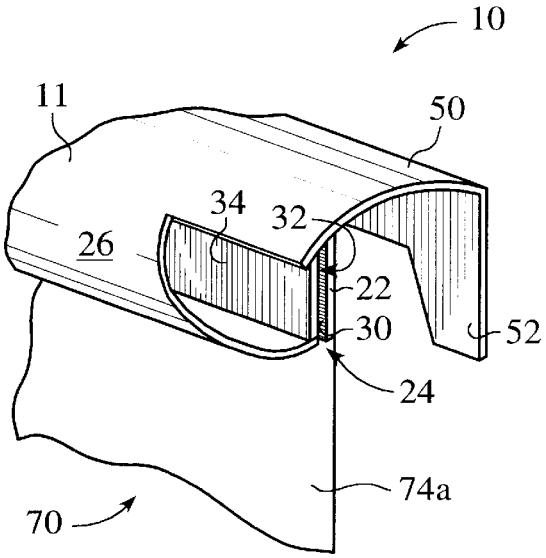
FIG. 4 shows a perspective view of an alternate construction of the coupling member shown in FIG. 2.

Turning to FIG. 2, it is shown that the coupling member 10 further includes unitarily formed hanging members (tangs) 52 and 54 which assist in supporting the file folder. It is noted that various alternate configurations are readily apparent. For example, the coupling member may be fabricated with just one hanging member 52 or 54, and still provide support for the file folder. One such configuration is exemplified in FIG. 4, which illustrates a coupling member having only one hanging member 52.

Figure 6:
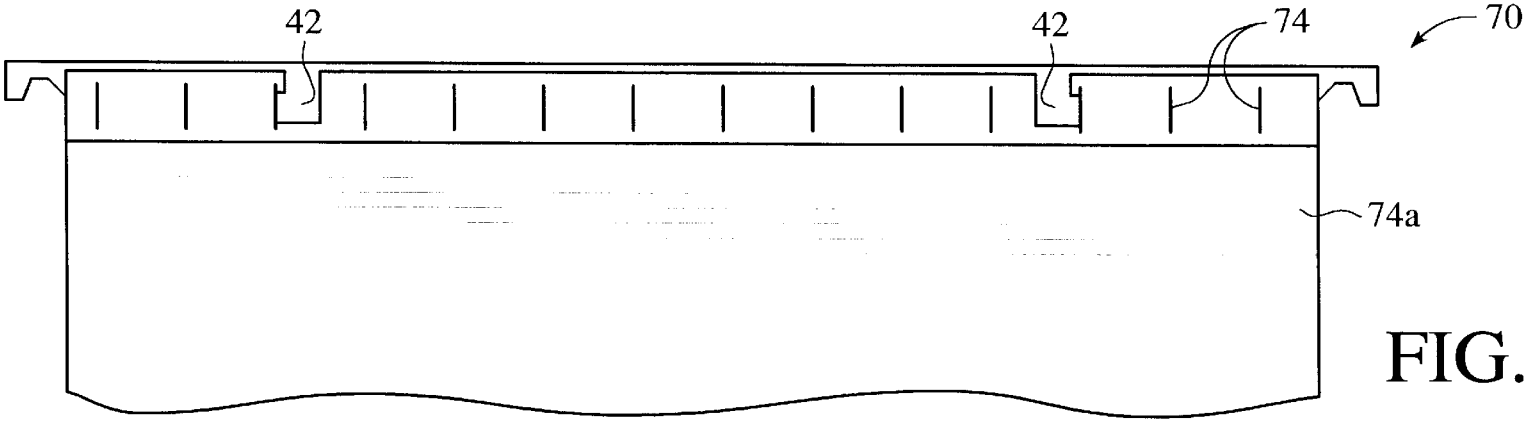
FIGS. 5 and 6 are two views of a variation of the embodiment illustrated in FIG. 3.
Figure 5:
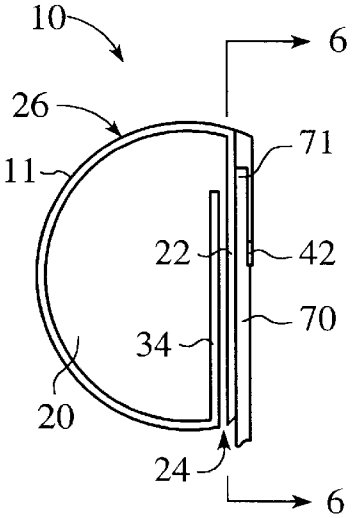

As an alternative to the adhesive strip 40 shown in FIG. 3, FIGS. 5 and 6 show a hooked notch 42 for providing attachment of the coupling member 10 to the folder 70. Typically, folders are formed with slots disposed along the inside surface of the lips for the insertion of file folder tabs. These slots can be utilized by the hooked notch 42 for attaching the coupling member.

Referring to FIG. 5, the hooked notch 42 is disposed along the elongate body 11 and is spaced apart from the flat portion 22. The notch may be an integral portion of the elongate body 11, or may be a separate component that is affixed to the elongate body. The lip 71 of the folder is received between the exterior surface of the flat portion 22 and the notch 42. Turning to FIG. 6, the notch 42 is shown engaged within a slot 74 formed in the folder 70, thereby pressing the exterior surface of the flat portion 22 against the folder. The hooked notch 42 allows detachable coupling of the coupling member 10, and so provides for re-use of the coupling member.

The hook portion of the notch 42 which fits into the slot may be oriented in any one of a number directions. In a preferred embodiment, the coupling member includes two hooked notches 42, wherein the hook portions are directed away from each other, as shown in FIG. 6. In an alternate embodiment, the hook portions may be oriented to face toward each other (not shown) or such that each faces to the left or to the right (not shown). The arrangement of the hooks in the notches 42 of the preferred embodiment provides a secure attachment of the coupling member 10 to the folder 70.

Figure 7:
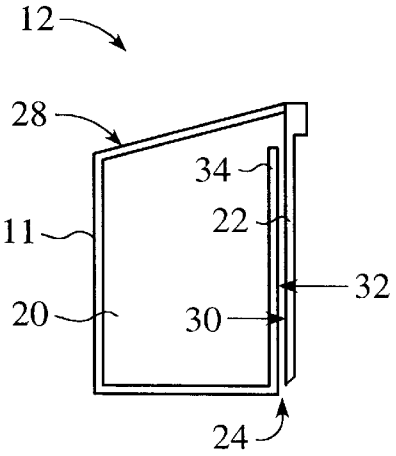
FIG. 7 illustrates an embodiment wherein the coupling member includes a transverse flat surface.

Returning to FIG. 1, it can be seen that the exterior surface of the coupling member 10 is ideal for use as a labeling area, using either permanently attached labels or removable labels. Informative folder titles are possible since the entire exposed portion of the elongate body 11 is available. FIG. 7 illustrates an alternative embodiment wherein the cross-sectional profile of the coupling member 12 has a shape that is not semi-circular. In particular, FIG. 7 shows an elongate body 11 having a rectangular profile with an upwardly facing flat surface 28. A flat surface further facilitates the placement of folder identification labels, and if desired allows for folder titles to be written directly on the surface. In general, the shape of the cross-sectional profile is not limited to those shown in the figures; other shapes are possible including a concave surface, a triangular profile and a generally rectilinear profile such as a square shape.

Figure 8:
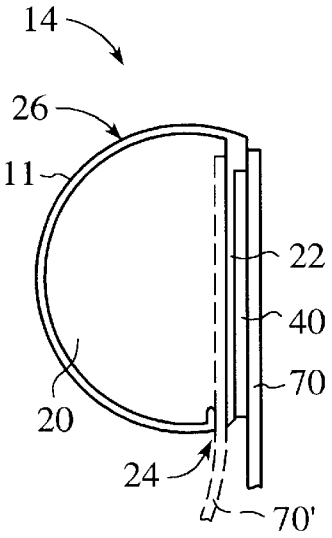
FIG. 8 is a cross-sectional view illustrating an embodiment of the coupling member wherein the slot does not include space dapart surfaces.

FIG. 8 shows a coupling member 14 of the present invention in which a longitudinal slot 24 is formed simply as an opening into the interior of the elongate body 11. The slot receives the lip of an adjacent folder 70' for insertion into the hollow interior 20 of the coupling member, thereby coupling the two folders 70, 70' together. The width of the slot 24 is on the order of one-sixteenth of an inch, so that insertion of the lip of an adjacent folder into the slot causes some degree of flexure of the elongate body 11, tending to widen the slot. The closing tendency of the flexed elongate body 11 serves to grip the lip of the adjacent folder, thus holding the adjacent folder in place.

Figure 9A:
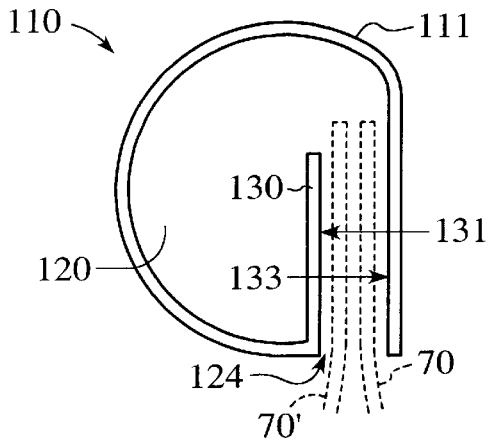
FIGS. 9A–9F show cross-sectional views of embodiments which obviate the adhesive layer.
Figure 9B:
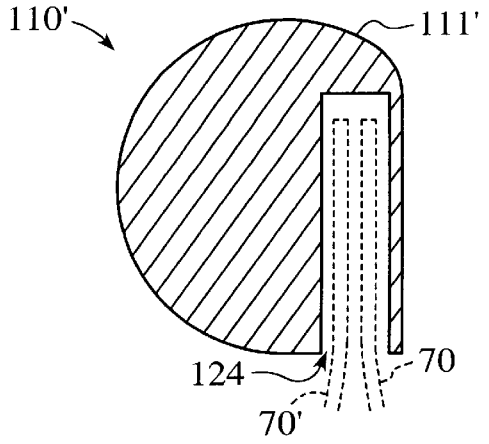
Figure 9C:
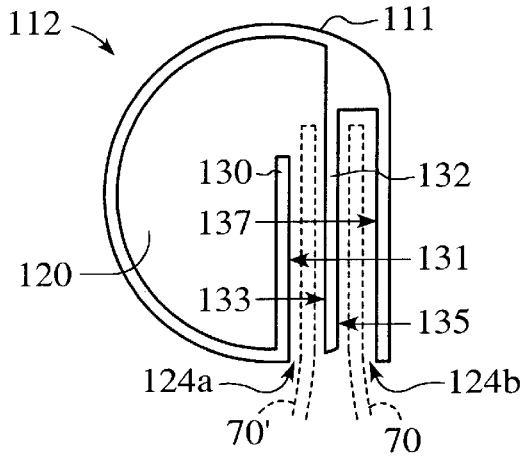
Figure 9D:
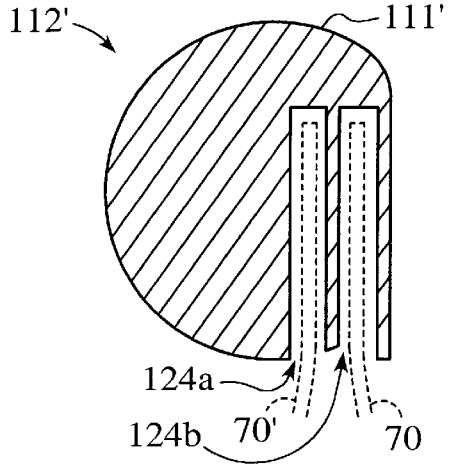
Figure 9E:
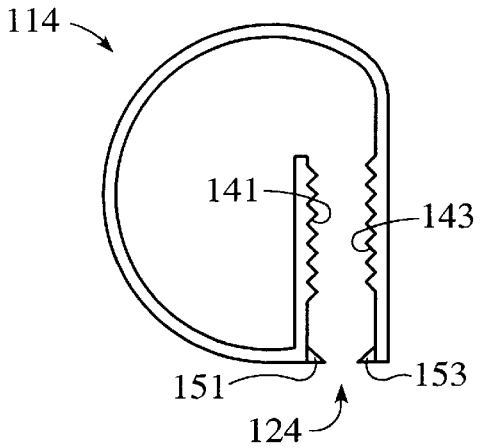
Figure 9F:
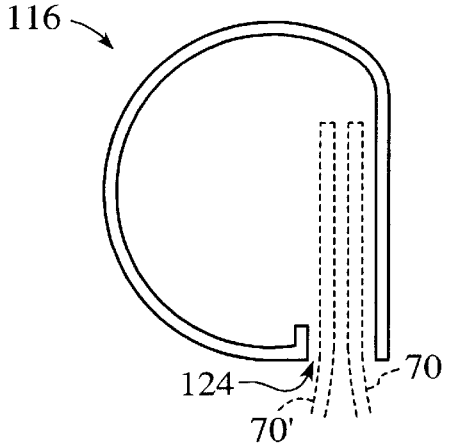

FIGS. 9A–9F are cross-sectional views of yet another embodiment of the invention. The coupling member 110 shown in FIG. 9A is an elongate resilient member 111 having a slotted opening 124 which is sufficiently wide to receive two leaves of adjacent folders 70, 70' shown in phantom, yet flexes so that a restoring force provides a gripping action upon the inserted leaves. To further enhance the gripping action, a pair of opposed surfaces 131, 133 extending from the opening 124 into the interior 120 of the elongate member 111 is provided. FIG. 9F shows a variation of this embodiment absent the interior surface 131, the gripping action being provided by the restoring force at the mouth of-the opening 124 as it clamps onto the inserted leaves. FIG. 9B shows a variation of FIG. 9A wherein the elongate body 111' is a solid member.

FIG. 9C shows another embodiment of the invention, wherein the coupling member 112 comprises two slotted openings 124A, 124B. Each slotted opening receives a leaf of one of two adjacent folders 70, 70'. As in the embodiment shown in FIG. 9A, opposed pairs of surfaces 131/133, 135/137 extend into the interior region 120 of the body 111 of the coupling member to provide an increased surface area for improved frictional engagement with the leaves. FIG. 9D shows a solid body variation of this embodiment.

FIG. 9E illustrates that the interior surfaces 131–137 of FIGS. 9A–9D can be further enhanced by imparting a texture to the surface, schematically illustrated by the surfaces 141, 143. The texture can be part of the manufacturing process, i.e. injection molding, wherein small corrugations, or line patterns, in the interior surfaces 141 and 143 increase the frictional contact with the inserted leaves. FIG. 9E also shows the use of tabs 151, 153 disposed at the mouth of the slotted opening 124. The tabs provide additional gripping force to securely hold the inserted leaves.

The foregoing has been a description of the best mode contemplated for practicing the present invention. It is not intended that the practice of the invention solely be limited to the above-described embodiments. It is fully understood that enhancements, additions and modifications may be provided without departing from the spirit and the scope of the invention. For example, the coupling members may be manufactured from material such as a PVC-based resin or some other commonly used type of plastic, or may be formed out of metal stock such as aluminum. In addition, the coupling members may be provided in various colors and combinations of colors in order to further increase their utility. With respect to the embodiment illustrated in FIG. 4, the depth of the folder 70 need not be limited to hold the standard eight and one-half inch wide documents, but can be any arbitrary depth. It is apparent that various embodiments of the present invention would be well within the capabilities of a person of ordinary skill in the art and would fall within the true spirit and scope of the invention as defined by the claims which follow.

I claim:

1. In a system of hanging-type folder, each folder having a suspending rod passing through upper edge portions thereof, ends of said rods having notches formed therein, a folder interlocking member for coupling together two adjacent ones of said hanging-type folders, the folder interlocking member comprising:

a resilient elongate member extending a length substantially equal to the width of one of said hanging-type folders;

said elongate member being selectively detachable from said hanging-type folders;

said elongate member having friction means for frictionally engaging said upper edge portions of adjacent leaves of said adjacent hanging-type folders, including a single slotted opening formed along a length of said elongate member for insertion thereinto of said upper edge portions, said slotted opening being dimensioned to exhibit flexure upon insertion of said upper edge portions, a secure attachment being maintained by a restoring force of said elongate member;

said elongate member having an upper portion disposed in opposed relation to said single slotted opening for occluding the gap between adjacent leaves of adjacent folders, said upper portion extending substantially the full length of said elongate member so as to occlude the gap substantially along the full width of said adjacent leaves;

said elongate member having notched ends coextensive with said notches of said rods.

2. The folder interlocking member of claim 1 wherein said detachable elongate member has either a circular, rectilinear, or triangular cross section.

3. The folder interlocking member of claim 1 wherein said detachable elongate member is substantially a solid member.

4. The folder interlocking member of claim 1 wherein said friction means further includes two substantially parallel spaced apart surfaces extending from said single slotted opening into an interior region of said elongate member.

5. The folder interlocking member of claim 4 wherein one of said spaced apart surfaces is textured for increased frictional contact with an inserted upper edge portion of a leaf of a folder.

6. The folder interlocking member of claim 4 wherein both of said spaced apart surfaces are textured for increased frictional contact with an inserted upper edge portion of a leaf of a folder.

7. In a system of hanging-type folders, each folder having a suspending rod passing through upper edge portions thereof, ends of said rods having notches formed therein, a folder interlocking member for coupling together two adjacent ones of said hanging-type folders, the folder interlocking member comprising:

a detachable elongate member extending a length substantially equal to the width of a folder;

said detachable member having a first slotted opening for receiving an upper edge portion of a leaf of a first folder;

said detachable member having a second slotted opening for receiving an upper edge portion of a leaf of a folder adjacent said first folder;

said detachable member having an upper portion disposed in opposed relation to said slotted openings for preventing formation of a gap between adjacent leaves of adjacent folders, said upper portion extending substantially the full length of said detachable member.

8. The folder interlocking member of claim 7 further including a partition separating said first and second slotted openings.

9. The folder interlocking member of claim 7 wherein said detachable member has a substantially circular, rectilinear, or triangular cross section.

10. The folder interlocking member of claim 7 wherein said detachable member is substantially a solid member.

11. The folder interlocking member of claim 7 wherein each of said first and second slotted openings is defined by two substantially parallel spaced apart surfaces extending into an interior region of said elongate member to provide friction engaging surfaces for an inserted leaf of a folder.

12. The folder interlocking member of claim 11 wherein, for each of said first and second slotted openings, at least one of said spaced apart surfaces is textured for increased frictional contact with an inserted leaf of a folder.

* * * * *